US007884688B2

(12) United States Patent
Takemoto et al.

(10) Patent No.: US 7,884,688 B2
(45) Date of Patent: Feb. 8, 2011

(54) WAVEGUIDE CONNECTOR AND ASSEMBLY USING DEFORMABLE CONVEX CONDUCTIVE PORTIONS

(75) Inventors: Dai Takemoto, Nishinomiya (JP); Mitsuhiko Hataya, Nishinomiya (JP)

(73) Assignee: Furuno Electric Co., Ltd., Nishinomiya (JP)

( * ) Notice: Subject to any disclaimer, the term of this patent is extended or adjusted under 35 U.S.C. 154(b) by 139 days.

(21) Appl. No.: 12/230,405

(22) Filed: Aug. 28, 2008

(65) Prior Publication Data

US 2009/0058571 A1 Mar. 5, 2009

(30) Foreign Application Priority Data

Aug. 31, 2007 (JP) ..... 2007-225956

(51) Int. Cl.
*H01P 1/04* (2006.01)

(52) U.S. Cl. ..... 333/254

(58) Field of Classification Search ..... 333/254, 333/255

See application file for complete search history.

(56) References Cited

U.S. PATENT DOCUMENTS 2,548,404 A * 4/1951 Sobel et al. ..... 285/406
2,892,987 A * 6/1959 Cedrone ..... 333/254

FOREIGN PATENT DOCUMENTS

JP 6-350301 A 12/1994
JP 7-79101 A 3/1995
JP 2000-134016 A 5/2000
JP 2007-5955 A 1/2007

* cited by examiner

*Primary Examiner*—Benny Lee
(74) *Attorney, Agent, or Firm*—Birch, Stewart, Kolasch & Birch, LLP

(57) ABSTRACT

A waveguide connector is provided. The connector includes a connecting portion having a plurality of conductive convex portions that are deformable by an external force. The convex portions are formed with a height and an interval less than ¼ wavelength of a propagating electromagnetic wave to be propagated inside waveguides.

9 Claims, 12 Drawing Sheets

CONVENTIONAL ART

WAVEGUIDE CONNECTOR AND ASSEMBLY USING DEFORMABLE CONVEX CONDUCTIVE PORTIONS

CROSS-REFERENCE TO RELATED APPLICATION(S)

This application claims priority under 35 U.S.C. §119 to Japanese Patent Application No. 2007-225956, which is filed on Aug. 31, 2007, the entire disclosure of which is hereby incorporated by reference.

TECHNICAL FIELD

The present invention relates to a connecting structure of waveguides for preventing a leakage of an electromagnetic wave from the waveguides.

BACKGROUND

FIG. 12 shows a conventional waveguide connecting structure. As illustrated, two hollow waveguides 100 and 200 to be connected together include flanges 101 and 201 at the connecting ends thereof, respectively. The connection can be made by aligning openings 102 and 202 of the waveguides 100 and 200 through which an electromagnetic wave are propagated, and then, pressing one of the waveguides 100 (or 200) against the other waveguide 200 (or 100) to join the flanges 101 and 201 together along a direction designated by the arrows.

In this construction, it is difficult to achieve high flatness (including surface roughness, surface irregularity, parallelism, etc.) throughout the flange surfaces, there may be a high number of gaps between the flanges. Thus, a leakage of an electromagnetic wave may occur from the gaps.

It is difficult to process the flanges with high flatness at low cost. Therefore, to address the leakage, for example, instead of depending only on the flatness of the flanges, Japanese Unexamined Patent Application Publication No. 2007-5955 discloses a deformable projection formed around an opening of one of the flanges. The projection can be plastically deformed when the flanges are pressed together so that the deformed projection fills the gaps to prevent the leakage.

However, in the above construction, the pressure of the flanges must be properly controlled and, thus, the flanges may be required to be bolted together to achieve the proper pressure. Furthermore, if the flanges cannot be bolted together for some reason (i.e., the space around the flanges is limited), a proper pressure cannot be applied to the flanges. Moreover, the bolt construction makes it difficult to disassemble the flange connection for maintenance and replacement of the components.

SUMMARY OF THE INVENTION

The present invention addresses the above conditions and, thus, it provides a waveguide connector and a waveguide assembly that can prevent a leakage of an electromagnetic wave from a connection between waveguides without the fixing structure between flanges of the waveguides (e.g., bolting the flanges together).

According to one aspect of the invention, a waveguide connector includes a connecting portion having a plurality of conductive convex portions that are deformable by an external force. The convex portions may be formed with a height and an interval less than ¼ wavelength of a propagating electromagnetic wave to be propagated inside the waveguides.

According to another aspect of the invention, a waveguide assembly includes a first waveguide, a second waveguide connected to the first waveguide, and a waveguide connector fixed to the first waveguide, including a connecting portion having a plurality of convex portions that are deformable by an external force. The convex portion may be formed with a height and an interval less than ¼ wavelength of a propagating electromagnetic wave to be propagated inside the waveguides so that the second waveguide and the waveguide connector are electrically connected through gaps less than ¼ wavelength of the propagating electromagnetic wave.

According to still another aspect of the invention, a waveguide assembly includes a first waveguide, a second waveguide connected to the first wave guide, and a waveguide connector including a connecting portion having a plurality of convex portions that are deformable by an external force. The convex portion may be formed with a height and an interval less than ¼ wavelength of a propagating electromagnetic wave to be propagated inside the waveguides so that the waveguide connector is electrically connected to the first and second waveguides through gaps less than ¼ wavelength of a propagating electromagnetic wave to be propagated within the waveguides.

The connecting portion may be made of an elastic material or a spring material.

BRIEF DESCRIPTION OF THE DRAWINGS

The present disclosure is illustrated by way of example and not by way of limitation in the figures of the accompanying drawings, in which the like reference numerals indicate like elements and in the different drawing figures and those like reference numbers may not all be described in detail in the drawing figures in which they appear, and in which.

DETAILED DESCRIPTION OF THE PREFERRED EMBODIMENT

Figure 1:
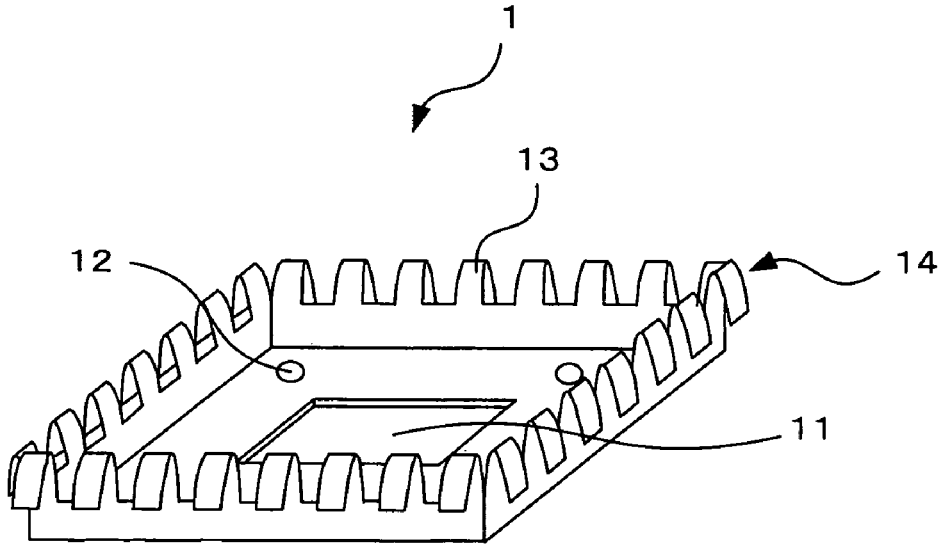
FIG. 1 is a perspective view showing a waveguide connector according to one embodiment of the present invention.

Hereinafter, embodiments of the present invention will be explained in detail with reference to the appended drawings.

In the following embodiments, the term "vertical" is only illustrative herein and typically shows the same vertical direction as shown in the figures with respect to the typical orientation of a waveguide connector. Therefore, the vertical direction and other corresponding directions may vary according to the orientation of the waveguides.

Embodiment 1

This embodiment will be described referring to FIGS. 1-8. First, referring to FIGS. 1-3, a waveguide connector 1 of this embodiment is partially or entirely made of a conductive material, and includes an opening 11 (FIGS. 1, 3) formed in a base portion thereof, holes 12 (FIGS. 1, 3) for screws to connect this waveguide connector 1 onto one of the waveguides 2 and 3 (in this embodiment, waveguide 3; see FIG. 4), and a connecting portion 14 having a plurality of convex portions 13 formed around the base portion. In this example, the waveguide connector 1 is illustrated as a square shape in a plane view. However, it is appreciated by those skilled in the art that the shape (including the shape of the opening 11) may be varied according to the cross-sectional shape of the waveguides (including the shape of opening portions of the waveguide, as described later).

Figure 4:
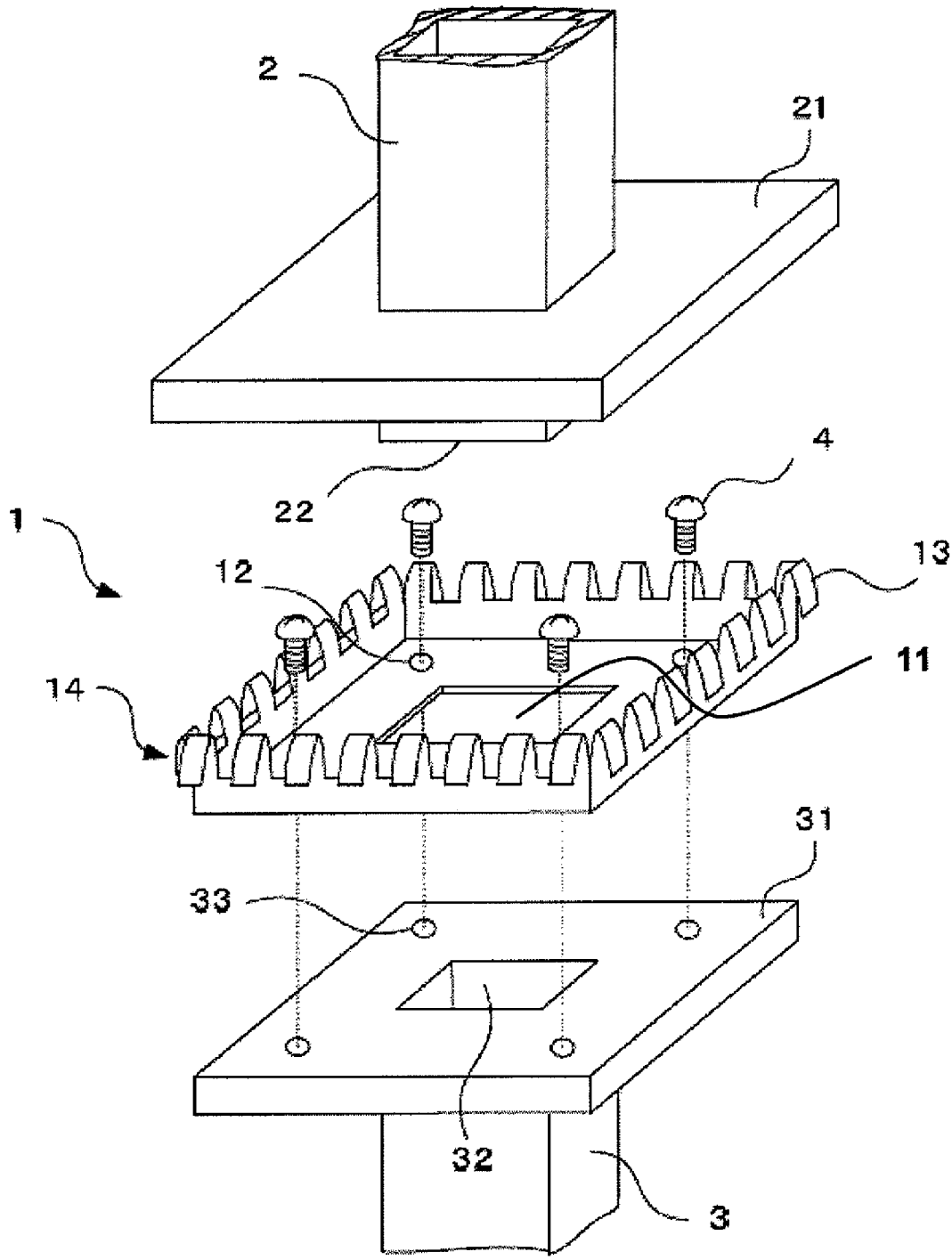
FIG. 4 is an exploded perspective view showing a connection of waveguides by the waveguide connector shown in FIG. 1.

Also referring to FIG. 4, the opening 11 is provided to allow an electromagnetic wave to be propagated between the opening portions 22 and 32 of the waveguides 2 and 3 without interruption. Thus, upon connecting the waveguides, the opening 11 is aligned with the opening portions 22 and 32 of the waveguides 2 and 3.

Figure 5:
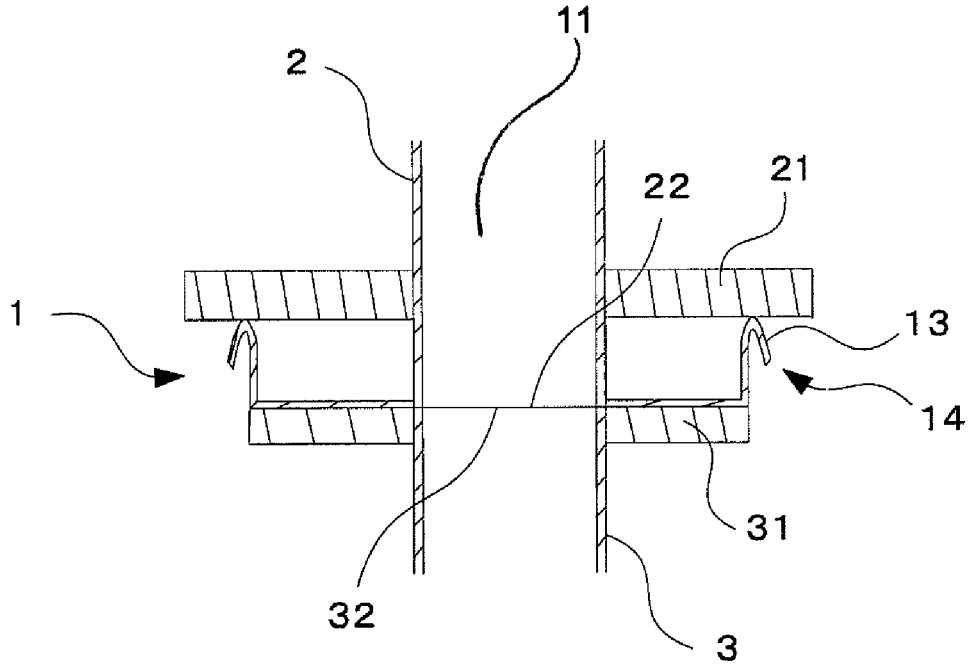
FIG. 5 is a cross-sectional view showing the connection shown in FIG. 4.

The convex portions 13 are formed around the base portion of the waveguide connector 1 so that the convex portions 13 surround a contacting portion of the opening portions 22 and 32 of the waveguides 2 and 3 (see FIG. 5). Each of the convex portions 13 has a height less than ¼ wavelength of a propagating electromagnetic wave inside the waveguides. Further, the convex portions 13 are spaced at intervals less than ¼ wavelength of the propagating electromagnetic wave. At least the convex portions 13 of the waveguide connector 1 is deformable by an external force. In this embodiment, the convex portion 13 is made of an elastic or plastic material, as described later in detail, such as a spring material or rubber material. In this embodiment, the convex portions 13 are made of a spring material which deform at least in the vertical direction. The convex portions 13 may be different or separate material or member from the base portion of the waveguide connector 1 as long as they have elasticity or plasticity and conductivity, as described in detail later.

Referring to FIGS. 4 and 5, upon connecting the waveguides, the convex portions 13 of the waveguide connector 1 are elastically deformed with a pressure applied by a flange 21 of the waveguide 2 that is fitted onto the convex portions 13. Accordingly, all the convex portions 13 certainly contact the flange 21. This construction allows the waveguide connector 1 and the waveguide 2 to electrically connect each other with gaps less than ¼ wavelength of the propagating electromagnetic wave, even though heights of the convex portions 13 constituting the connecting portion 14 vary in some degree.

In this case, the pressure applied to the convex portions 13 may be sufficient if the deformation of the convex portions 13 is greater than the original height variation (before contacting the flange) of the convex portions 13. Therefore, all the convex portions 13 can certainly contact the flange surface of the waveguide 2 with a relatively small force, such as by a weight of the waveguide 2 itself, without applying a large contacting force by bolts, such as in the conventional construction.

Further, because the convex portions 13 of this embodiment are not required to be manufactured with high accuracy, the waveguide connector 1 can be easily manufactured by pressing a metal sheet, etc. Further, because the material of the waveguide connector 1 is partially or entirely conductive, the waveguide connector 1 may be manufactured at a low cost by using a stainless-steel sheet of an approximately 0.2-0.5 mm thickness. Preferably, the waveguide connector 1 may be made of a material of equal or less strength with respect to that of the waveguides.

Figure 2:
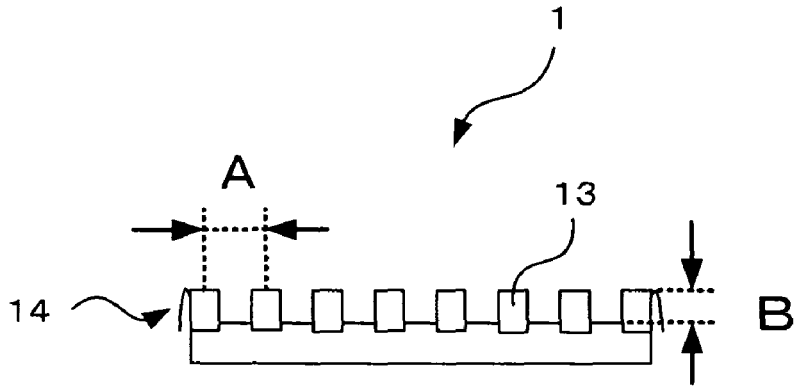
FIG. 2 is a side view showing the waveguide connector shown in FIG. 1.
Figure 3:
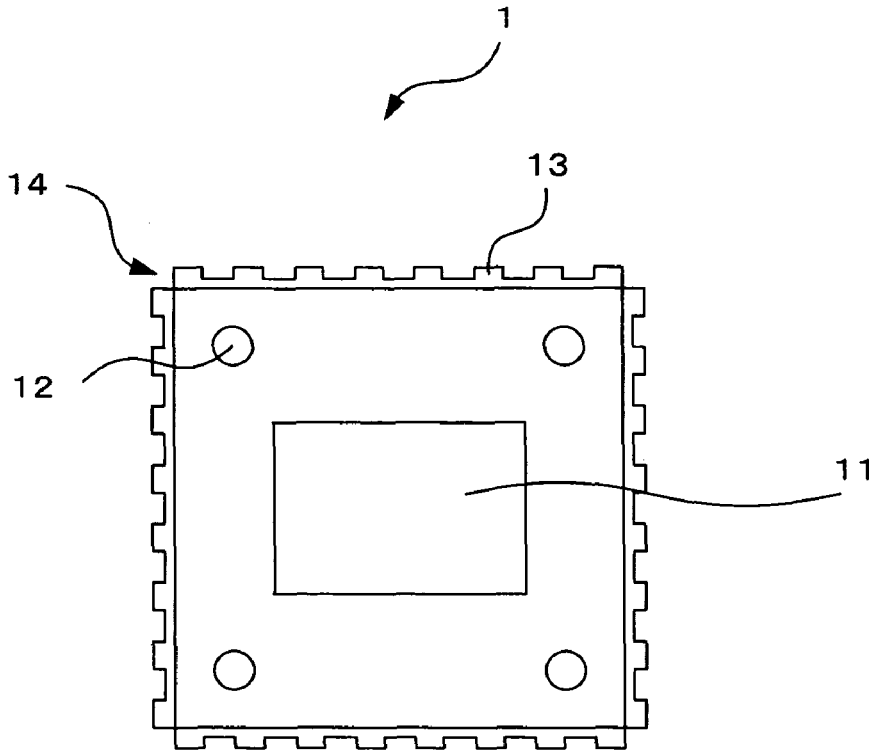
FIG. 3 is a plan view showing the waveguide connector shown in FIG. 1.

The interval and height of the convex portions 13 may be such that, upon connecting the waveguides, the convex portions 13 contact the flange 21 of the waveguide 2 only by a pressure applied from the flange 21, with gaps less than ¼ wavelength of the propagating electromagnetic wave. For example, as shown in FIG. 2, an interval "A" between the centers of adjacent convex portions 13 and the maximum height "B" of the convex portions 13 are both less than ¼ wavelength of the propagating electromagnetic wave.

This allows the convex portions 13 to contact the waveguide 2 without gaps greater than ¼ wavelength of the propagating electromagnetic wave, and allows the waveguide connector 1 to electrically connect the waveguide 2 through gaps less than ¼ wavelength of the propagating electromagnetic wave. In other words, when connecting the waveguides 2 and 3, the convex portions 13 flex by the pressure applied from the flange 21, and the waveguide connector 1 electrically connects the waveguide 2 at the convex portions 13 thereof with the gaps less than ¼ wavelength of the propagating electromagnetic wave to prevent the leakage of the electromagnetic wave.

Preferably, the distance between adjacent convex portions 13 may also be configured so that distal edges of the adjacent convex portions 13 are spaced from each other for less than ¼ wavelength of the propagating electromagnetic wave. As a result, the waveguide and the convex portions 13 can certainly contact each other with the gaps less than ¼ wavelength of the propagating electromagnetic wave even when variation in dimension (particularly, height) of the convex portions 13 is in the worst scenario.

Next, an assembling procedure of the waveguides with the waveguide connector 1 of this embodiment will be explained referring to FIGS. 4 and 5. In this embodiment, as illustrated, the opening 22 of the waveguide 2 protrudes from a flange surface of the flange 21, and the opening portion 32 of the waveguide 3 is leveled with a flange surface of the flange 31. In this embodiment, the waveguides 2 and 3 and the flanges 21 and 31 are all conductive.

First, the opening 11 of the waveguide connector 1 is aligned with the opening portion 32 of the waveguide 3, and then, the waveguide connector 1 and the flange 31 of the waveguide 3 are fastened with screws 4 (FIG. 4). Here the alignment may be easily performed by aligning the screw holes 12 and 33 as shown in FIG. 4 as the screws 4 threadedly engage with the threaded holes 33 as shown in FIG. 4.

Then, the waveguide 2 is located onto the connecting portion 14 of the waveguide connector 1 so that the opening portions 22 and 32 of the waveguides 2 and 3 contact each other (see FIG. 5). During this step, the convex portions 13 constituting the connecting portion 14 flex downwardly under the pressure applied from the flange 21 of the waveguide 2. As a result, all the convex portions 13 and the waveguide 2 contact each other through the gaps less than ¼ wavelength of the propagating electromagnetic wave to be propagated inside the waveguides.

This allows the waveguide connector 1 and the waveguides 2 and 3 to electrically connect with each other through the gaps less than ¼ wavelength of the propagating electromagnetic wave. As a result, it is possible to prevent the leakage of the propagating electromagnetic wave to be propagated inside the waveguides 2 and 3 without fastening the waveguides together with any fasteners, such as screws, bolts, etc.

Figure 6:
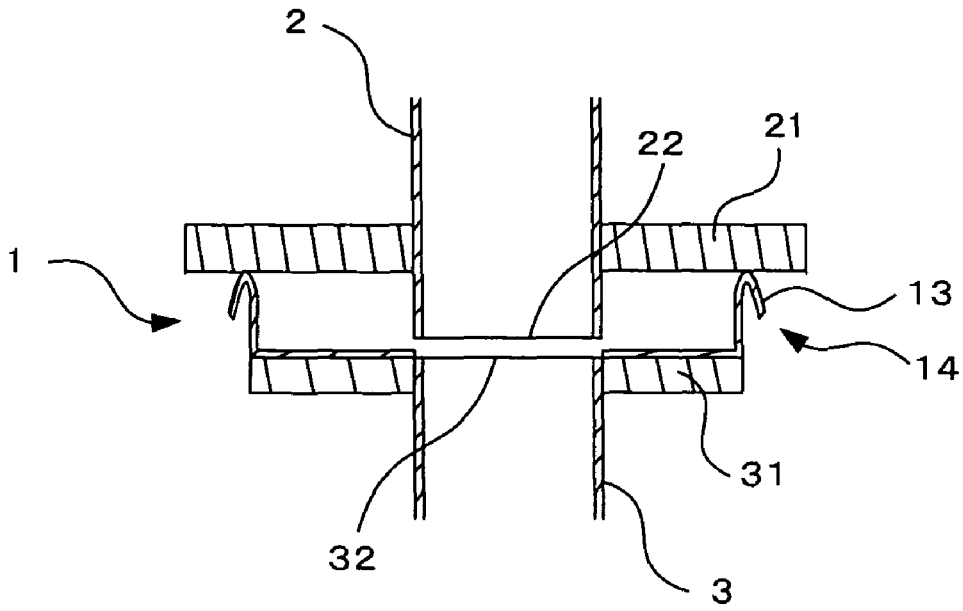
FIG. 6 is a cross-sectional view of another example of the connection of the waveguides by the waveguide connector shown in FIG. 1.

In this embodiment, the opening portions 22 and 32 of the waveguides 2 and 3 do not necessarily contact with each other, unlike conventional structure. Therefore, as shown in FIG. 6, even if the opening portions 22 and 32 of the waveguides 2 and 3 are physically apart from each other, the leakage of the electromagnetic wave can be effectively reduced using the waveguide connector 1 of this embodiment.

Figure 7:
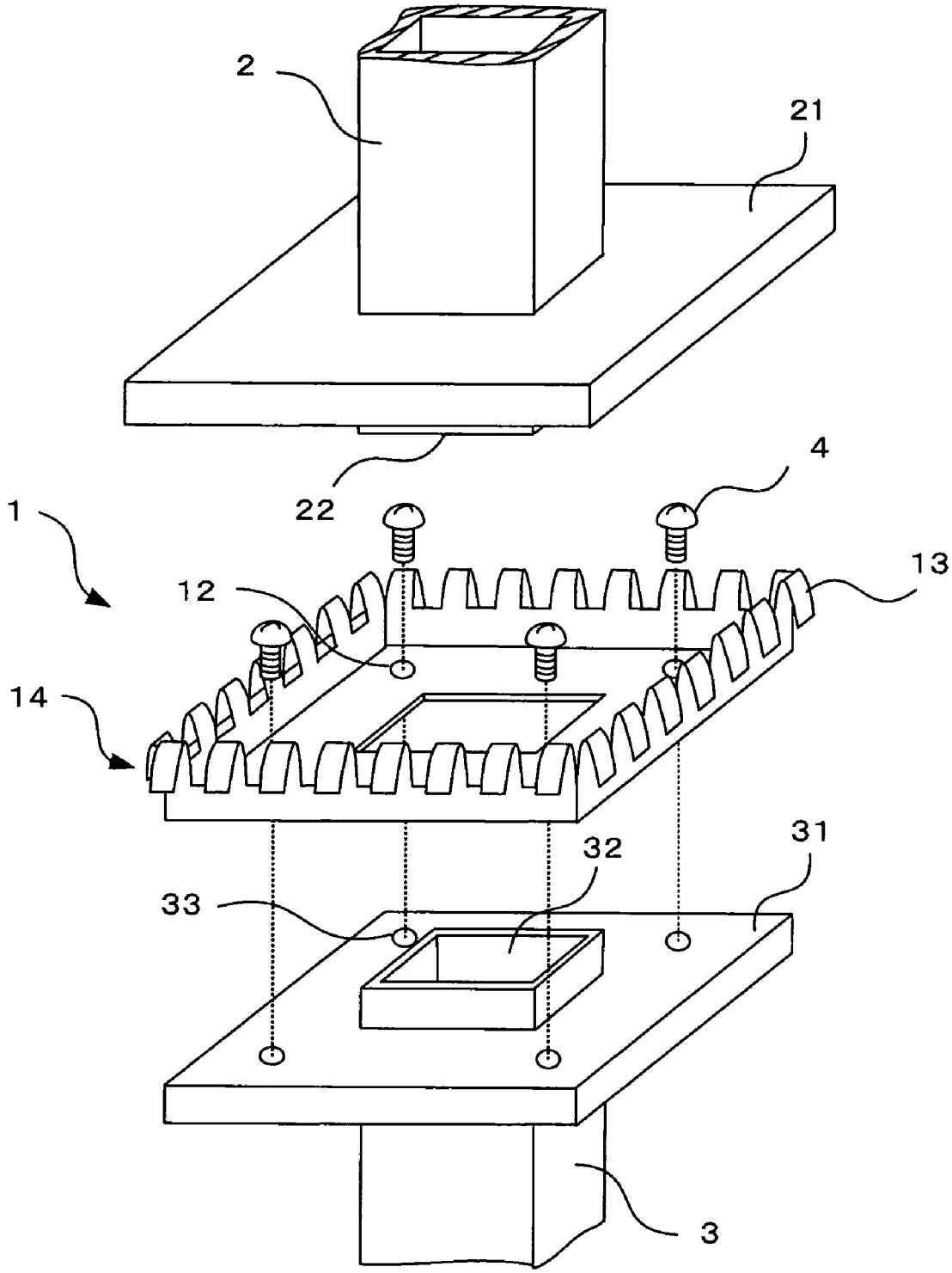
FIG. 7 is an exploded perspective view of still another example of the connection of the waveguides by the waveguide connector shown in FIG. 1.
Figure 8:
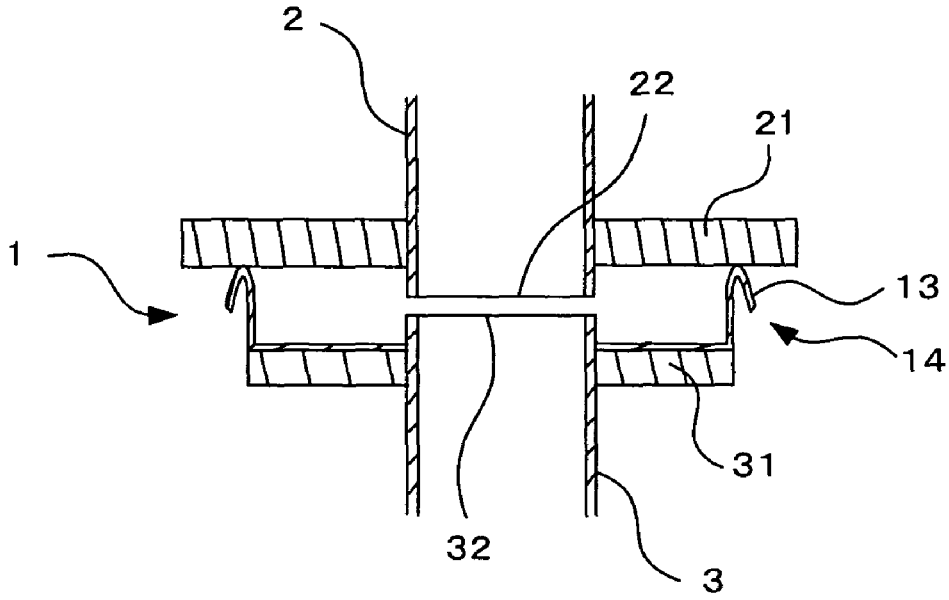
FIG. 8 is a cross-sectional view showing the connection shown in FIG. 7.
Figure 9:
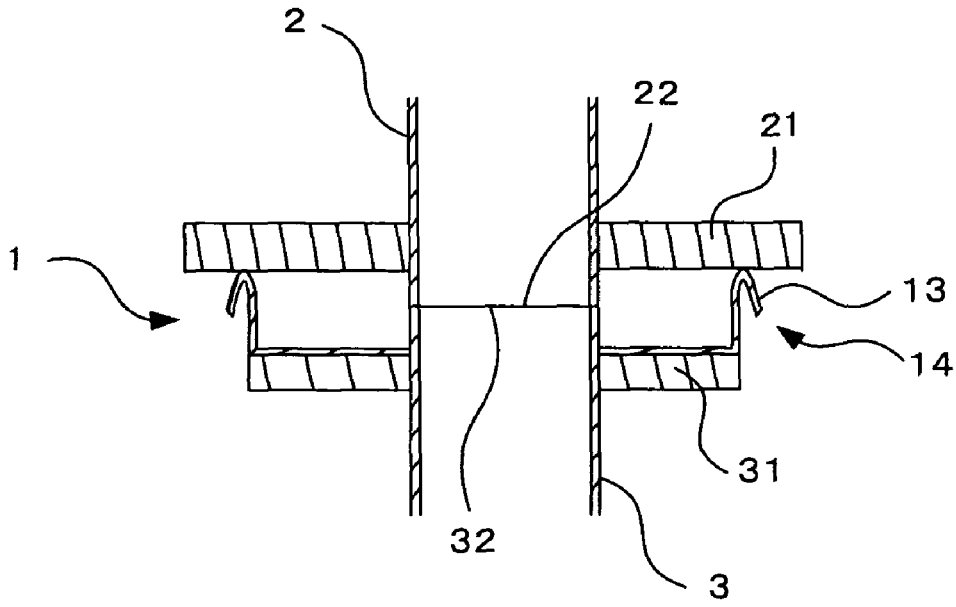
FIG. 9 is a cross-sectional view of another example of the connection shown in FIG. 8.

Alternatively, as shown in FIG. 7, using the same waveguide connector 1, the opening portion 32 of the waveguide 3 may protrude from a flange surface of the flange 31. The protruding end of the opening portion 32 may reach between the thickness of the waveguide connector 1 (in other words, between the contacting surface of the connecting portion 14 with the flange surface of the flange 21 of the waveguide 2 and the base portion of the waveguide connector 1). As a result, the opening portions 22 and 32 of the waveguides 2 and 3 are completely and laterally surrounded by the waveguide connector 1, and thereby, further reduces the leakage of the electromagnetic wave. In order to attain this effect, it is not necessary to have a physical contact between the opening portions 22 and 32 as illustrated in FIG. 8. Alternatively, as shown in FIG. 9, physically contacting the opening portions 22 and 32 with each other may also be possible so that the leakage of the electromagnetic wave can be significantly reduced with respect to the above construction of FIG. 7.

Embodiment 2

Figure 10:
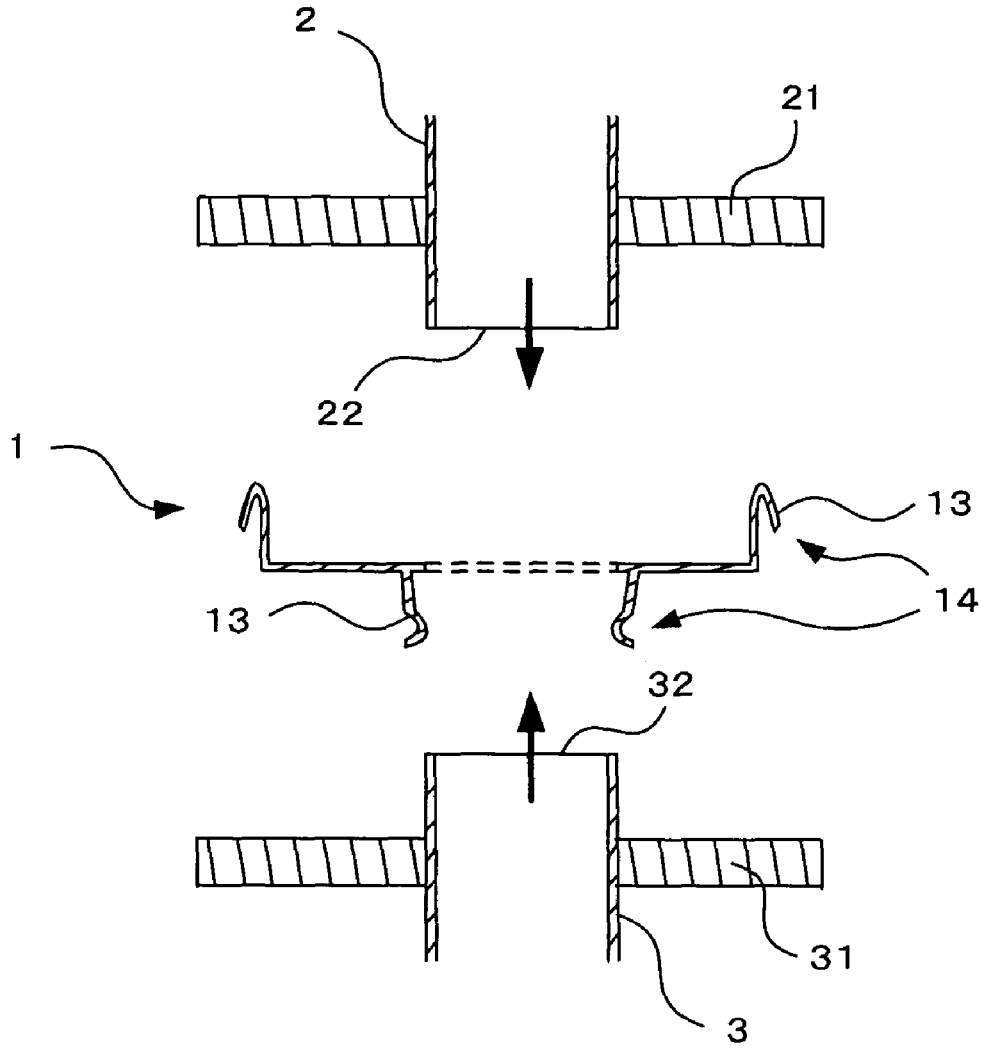
FIG. 10 is an exploded cross-sectional view showing a connection of waveguides by a waveguide connector according to another embodiment of the present invention.
Figure 11:
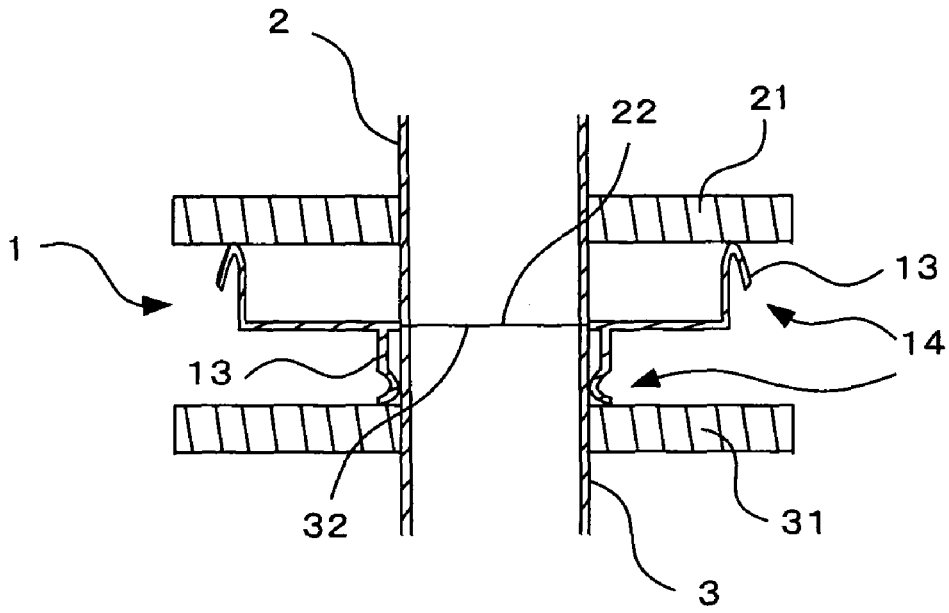
FIG. 11 is a cross-sectional view showing the connection shown in FIG. 10.
Figure 12:
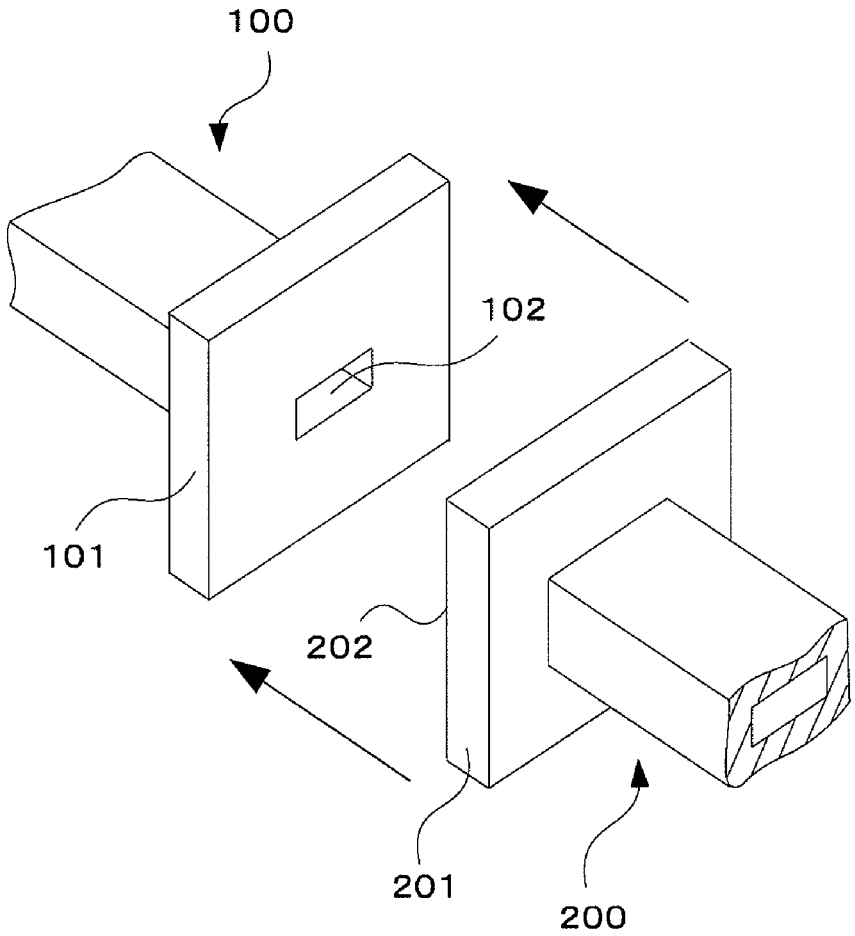
FIG. 12 is a view showing a conventional waveguide connecting structure.

Another embodiment will be explained referring to FIGS. 10 and 11 in which another and second connecting portion 14 constituting convex portions 13 is also provided to the waveguide connector 1 on the side of the waveguide 3. As a result, it is possible to prevent the leakage of the electromagnetic wave from the contacting surface between the waveguide connector 1 and the waveguide 3. In this embodiment, the second convex portions 13 have similar shape and function to that of the first convex portions 13, however, particularly but exemplary, a configuration in which the second convex portions 13 provided on the side of the waveguide 3 flex outwardly by inserting the waveguide 3 into the second convex portions 13, instead of flexing vertically like the first convex portions 13.

More specifically, as the waveguides 2 and 3 are connected through the waveguide connector 1 of this embodiment, the first convex portions 13 provided on the side of the waveguide 2 flex downwardly so that the first connecting portion 14 contacts the waveguide connector 1 and the flange 21 of the waveguide 2 through gaps less than ¼ wavelength of the propagating electromagnetic wave. Further, the second convex portions 13 provided on the side of the waveguide 3 flex laterally, and the second connecting portion 14 of the waveguide connector 1 contact the peripheral of the waveguide 3, and then, also contact the flange 31 of the waveguide 3, through gaps less than ¼ wavelength of the propagating electromagnetic wave.

As a result, the waveguide connector 1 and the waveguides 2 and 3 electrically connect to each other through gaps less than ¼ wavelength of the propagating electromagnetic wave. Therefore, it is possible to prevent the leakage of the propagating electromagnetic wave to be propagated inside the waveguides 2 and 3 with no fasteners, such as the screws 4 as described in the previous embodiment (e.g. see FIGS. 4, 7).

All of the above embodiments described the connecting structure of the waveguides with less fasteners for the connection of the waveguides, however, the configuration of the connecting portions 14 and the convex portions 13 may also be applicable to the conventional connecting structure of the waveguides using fasteners to fasten the waveguides without any modification to the existing structure of the waveguides using the wave guide connector of these embodiments.

The subject matter of the present disclosure includes all novel and nonobvious combinations and subcombinations of the various systems and configurations, and other features, functions, and/or properties disclosed herein. The following claims particularly point out certain combinations and subcombinations regarded as novel and nonobvious. These claims may refer to "an" element or "a first" element or the equivalent thereof. Such claims are understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A waveguide connector comprising:

a connecting portion having a plurality of conductive convex portions;

wherein the convex portions each having a height and a distance between each other less than ¼ wavelength of a propagating electromagnetic wave to be propagated inside waveguides; and wherein said plurality of conductive convex portions are deformable in a vertical direction along the height with a pressure applied by the waveguides.

2. The waveguide connector of claim 1, wherein the connecting portion comprises an elastic material.

3. The waveguide connector of claim 1, wherein the connecting portion comprises a spring material.

4. A waveguide assembly, comprising:

a first waveguide;

a second waveguide connected to the first waveguide; and a waveguide connector fixed to the first waveguide, including a connecting portion having a plurality of convex portions;

wherein each convex portion has a height and a distance between each other that are respectively less than ¼ wavelength of a propagating electromagnetic wave to be propagated inside the first and second waveguides so that the second waveguide and the waveguide connector are electrically connected through gaps less than ¼ wavelength of the propagating electromagnetic wave; and wherein said plurality of conductive convex portions are deformable in a vertical direction along the height with a pressure applied by the waveguides.

5. The waveguide assembly of claim 4, wherein the connecting portion comprises an elastic material.

6. The waveguide assembly of claim 4, wherein the connecting portion comprises a spring material.

7. A waveguide assembly, comprising:

a first waveguide;

a second waveguide connected to the first wave guide; and a waveguide connector including a connecting portion having a plurality of convex portions;

wherein each convex portion has a height and a distance between each other that are respectively less than ¼ wavelength of a propagating electromagnetic wave to be propagated inside the first and second waveguides so that the waveguide connector is electrically connected to the first and second waveguides through gaps less than ¼ wavelength of a propagating electromagnetic wave to be propagated within the waveguides; and wherein said plurality of conductive convex portions are deformable in a vertical direction along the height with a pressure applied by the waveguides.

8. The waveguide assembly of claim 7, wherein the connecting portion comprises an elastic material.

9. The waveguide assembly of claim 7, wherein the connecting portion comprises a spring material.

* * * * *